US005746015A

United States Patent [19]

Clement et al.

[11] Patent Number: 5,746,015

[45] Date of Patent: May 5, 1998

[54] COMFORT LINER FOR SKI BOOT

[75] Inventors: Jean-Pierre Clement; Olivier Dalvy, both of Annecy-Le-Vieux, France

[73] Assignee: Salomon S.A., Metz-Tessy, France

[21] Appl. No.: 554,240

[22] Filed: Nov. 8, 1995

[30] Foreign Application Priority Data

Nov. 10, 1994 [FR] France ..... 94 13735

[51] Int. Cl.[6] ..... A43B 7/14; A43B 23/07; A43B 19/00

[52] U.S. Cl. ..... 36/93; 36/71; 36/117.6; 36/55; 36/10

[58] Field of Search ..... 36/93, 71, 10, 36/117.6, 89, 55

[56] References Cited

U.S. PATENT DOCUMENTS

| | | | |
|---|---|---|---|
| 2,318,148 | 5/1943 | Ettelbrick, Sr. et al. | 36/3 A |
| 3,834,044 | 9/1974 | McAusland et al. | 36/117.6 |
| 4,108,928 | 8/1978 | Swan, Jr. | 36/93 X |
| 4,120,064 | 10/1978 | Salomon | 36/93 X |
| 4,154,009 | 5/1979 | Kubelka et al. | 36/119 |
| 4,229,546 | 10/1980 | Swan, Jr. | 36/93 X |
| 4,301,564 | 11/1981 | Dalebout | 36/93 X |
| 4,433,494 | 2/1984 | Courvoisier et al. | 36/93 X |
| 4,809,379 | 3/1989 | Jungwirth | 36/93 X |
| 4,837,884 | 6/1989 | Hilgarth | 36/93 X |
| 5,050,319 | 9/1991 | Perroto et al. | 36/117 |
| 5,067,257 | 11/1991 | Coomer | 36/93 |
| 5,203,793 | 4/1993 | Lyden | 36/93 |

FOREIGN PATENT DOCUMENTS

| | | | |
|---|---|---|---|
| 0004829 | 10/1979 | European Pat. Off. | A43B 19/00 |
| 0370948 | 5/1990 | European Pat. Off. | A43B 5/04 |
| 585593 | 3/1994 | European Pat. Off. . | |
| 2360271 | 3/1978 | France | A43B 5/04 |
| 2460118 | 1/1981 | France | A43B 19/00 |
| 2106667 | 4/1972 | Germany . | |
| 2144826 | 5/1973 | Germany . | |
| 2-270519 | 5/1990 | Japan | A43B 19/00 |
| 680037 | 6/1992 | Switzerland . | |
| WO94/09663 | 5/1994 | WIPO | A43B 19/00 |

*Primary Examiner*—Ted Kavanaugh

*Attorney, Agent, or Firm*—Greenblum & Bernstein, P.L.C.

[57] ABSTRACT

A comfort liner for a ski boat provided with a wedging element made of foam having thermoplastic qualities rendering it adapted to be adjusted and/or adapted, after being heated at its thermoforming temperature, to the specific volume of the foot of the skier, and a ski boot incorporating such liner. The liner in its entirety is preformed to an initial foot fitting volume corresponding to the standard of a given size, and its wedging element, constituted by a foam formed from at least one thermoplastic material, is thermocompressed and micro-perforated. The micro-perforations confer to the wedging element a certain flexibility and elastic compressibility, as well as a certain permeability rendering it sufficiently comfortable to be used as such for skiing, and adapted to be easily thermoformed by reheating, by virtue of the rapid and in-depth diffusion of the heat across the micro-perforations.

16 Claims, 3 Drawing Sheets

COMFORT LINER FOR SKI BOOT

BACKGROUND OF THE INVENTION

1. Field of the Invention

The present invention relates to comfort liners positioned on the interior of ski boot shells and has as an object the use of a foam wedging element having thermoplastic qualities and adapted to adjust and/or to adapt itself, after it has been heated at its thermoforming temperature, to the specific volume of the foot of the skier.

2. Description of Background Information

In known ski boots comprising liners with this type of thermoplastic foam wedging element, the initial fitting volume, i.e., before adjustment by thermoforming, is, for a given size, either smaller than the standard of this size, or considerably larger, or still not defined. By way of example, such boots are described in European Patent Publication 004 829, French 2,460,118; and Japanese 2-270519 and in PCT Application WO 94/09663. As is disclosed, none of the liners used in these boots is preformed to a standard fitting volume for a given size, and thus cannot be utilized for skiing until after thermoforming. In effect, in the case of European Patent 004 829, it is a question of giving room for the foot because the initial cavity is under dimensioned by about one or two sizes with respect to the foot to which one wishes to adapt the boot. The process thus comprises heating the foam of the wedging element with the aid of an electric heating element, then, after introduction of the foot of the skier, compressing said wedging element which is sandwiched between the shell and said foot and allowing it to cool in this position.

In the case of French Publication 2,460,118 and Japanese 2-270519, it is the opposite operation which is performed. The liners are obtained preformed with thermocompressed walls, thus having a relatively high density in this state, and it is by heating them that one causes more or less their relaxation and thus their adjustment to the foot and the shell. As this appears clearly, the preforming by thermocompression necessitates providing a cavity, or fitting volume, which is much larger than the volume of the foot to be held because the constituent materials of the walls of the liners having been preliminarily thermocompressed have lost much of their flexibility, and it is impossible to readjust them if desired to a greater volume simply by pressure of the foot.

Such liners preformed by thermocompression thus have, for a given size, a considerably greater fitting volume, and their walls in the thermocompressed state have an elevated density which renders them inappropriate in assuring an acceptable comfort for the foot is they are not heated to relax, and thus in resorting a certain flexibility.

In the example of the comfort liner described in PCT Application WO 94/09663, the problem is different from the preceding problems because there, the liner is not preformed in its initial state, in fact the fitting volume is not defined; in effect, according to this document, it is essentially due to the integral heating of the liner that it is possible to adapt it on the foot, which, thus equipped, is then introduced in the boot. Therefore, this type of liner can not be, as in the preceding cases, utilized in its initial state for purposes of skiing.

Another disadvantage appears likewise in the liners described hereinabove and relates to the stability of the imprints achieved after reheating at the thermoforming temperatures of the materials utilized, such as polyethylene or polyeurathane. In effect, these materials which are made in the form of foam are sensitive to repeated pressure and are crushed and collapse with use. Thus, such liners must be readjusted to the foot of the skier relatively often so as to always provide an optimum grip and comfort. So as to limit the number of these readjustment interventions, it is known to play on the density of these foams: an elevated density providing a high resistance to crushing but a lesser comfort since it is less flexible and less compressible, and conversely, a low density providing a low resistance to crushing but an increased comfort by virtue of the flexibility and substantial compressibility of the foam.

Furthermore, in the case where the foam is made of polyeurathane, a supplemental problem is posed with respect to assuming an imprint, because such a foam is not thermoplastic and as a result cannot be put into a specific form or allow for an adjustment on the foot of the skier simply by means of a heat source. To overcome this disadvantage, it is proposed in Japanese Patent 2-270519 to mix with the polyeurathane a thermoplastic resin which, after cooling, fixes and stabilizes the polyeurathane foam in the form which is given to it, such as the imprint of the foot. The addition of the resin thus confers to the polyeurathane foam properties and behavior similar to those of a thermoplastic foam.

During a readjustment to a new foot imprint, it then suffices to heat the foam charged with resin until the foam becomes plastic to allow the polyeurathane to relax and/or to compress itself to the form imposed by this new imprint, and to let it cool. This type of liner with a wedging element of polyeurathane loaded with resin appears however relatively uncomfortable because the initial flexibility and compressibility of the polyeurathane foam are almost eliminated by the resin which, in fact, is the element which gives the consistency of the foam thus obtained.

This type of problem is not posed with foams obtained of thermoplastic materials such as polyethylene, ethylene vinyl acetate polymer, and polypropylene for example, because their thermoplastic nature does not require the addition of a resin. However, other disadvantages occur by virtue of their thermoplastic nature. One concerns their flexibility and compressibility which are relatively inferior than polyeurathane, which detracts from comfort; and the other, their sealed structure which does not permit a good diffusion of heat throughout their mass during the heating operation to bring them to the temperature which renders them plastic, and thus thermoformable.

SUMMARY OF THE INVENTION

The present invention aims to overcome these various disadvantages of known liners made of thermoplastic foam, and proposes a preformed liner having a standard initial fitting volume for a given size and being adapted to be utilized as such to hold the foot in the boot for skiing purposes, by assuring a comfort and a holding which is analogous to those of a classical liner, and adapted to be able to specifically adapt to the form of at least one part of the foot by reheating at a given temperature and then cooling.

To achieve this goal, the comfort liner for ski boots having a shell is provided preformed at a standard initial fitting volume for a given size, and comprises at least one wedging element made out of foam of a thermoplastic nature which is preformed by thermocompression. It is characterized by the fact that the wedging element made of thermoplastic foam is micro-perforated to:

improve its elastic compressibility and flexibility, thus its comfort, even in the preform state despite its elevated density (greater than 50 $Kg/m^3$).

provide it with a certain permeability allowing in particular the evacuation of the sweat relative to the foot, allow for a good and rapid diffusion of the heat throughout its mass during the heating operation so as to assume the imprint by virtue of the micro-perforations extending through it.

According to a preferred embodiment of the invention, the thermoplastic foam is a polyethylene foam, of ethylene vinyl acetate polymer, or of polypropylene, for example, but can of course be the result of the combination of a plurality of thermoplastic materials.

According to one embodiment, the wedging element is interposed between the exterior flexible or semiflexible wall of the liner and the comfort fabric constituting the interior wall of the latter, and the form of the imprint which is given to it by thermocompression in such that the fitting volume positioned opposite thereto corresponds to the standard fitting volume of the given size being considered.

Thus, for a "standard" foot, it is not necessary to resort to a particular adaptation of the liner which can be utilized as such; in effect, despite the fact that the wedging element is thermocompressed, and thus it has an elevated density in this state, the micro-perforations procuring for it a sufficient flexibility so as to be able to be retightened on the foot by traditional closure and tightening means of the shell of the boot in the same way as a conventional liner. On the contrary, in the case where the skier desires a more precise adaptation to his foot or at least to a portion thereof, it suffices to reactivate by heating only the concerned zone of the wedging element and to then tighten the element on the foot by means of closure and tightening means of the shell. The wedging element being sandwiched between the interior comfort fabric and the exterior wall of the liner which is generally flexible but non-extendible, the imprint occurs particularly on the side the foot of the skier.

According to another embodiment, the wedging element is not included or interposed in the wall of the liner but is attached, in the manner of an element conceived independently, on the wall of the said liner, to the exterior and/or interior of the latter.

BRIEF DESCRIPTION OF DRAWINGS

The present invention will be better understood with reference to the description which follows referring to the annexed schematic drawings giving, by way of example, several embodiments of the liner.

DETAILED DESCRIPTION

Figure 1:
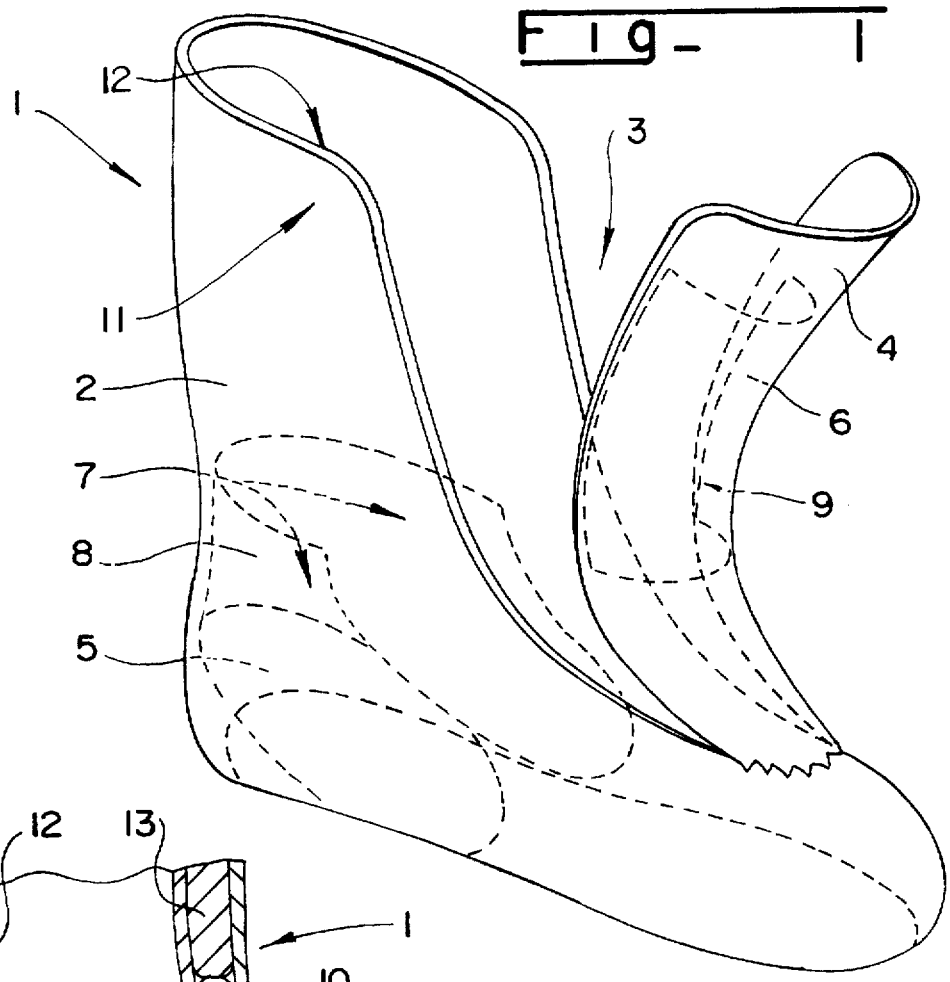
FIG. 1 illustrates, seen in perspective, a front opening liner having an upper and a tongue provided with thermocompressed wedging elements preformed and micro-perforated according to the invention.

The liner 1, illustrated in FIG. 1, has an upper 2 with a front opening 3 and a tongue 4 adapted to close the opening 3 back in the position of tightening and maintenance of the foot of the skier.

This liner 1 has a shape preformed at an initial standard fitting volume for a given size and is provided, in this example of construction, with two wedging elements 5 and 6 which are formed in the form of a foam from a thermoplastic material, the element 5 being positioned on the zone corresponding to the malleoli 7 and to the heel 8, and the element 6 on the zone corresponding to the instep/flexion fold 9. These elements are preformed by thermocompression and have an initial imprint of a shape substantially corresponding to that of the zone of the foot which they cover.

Figure 2:
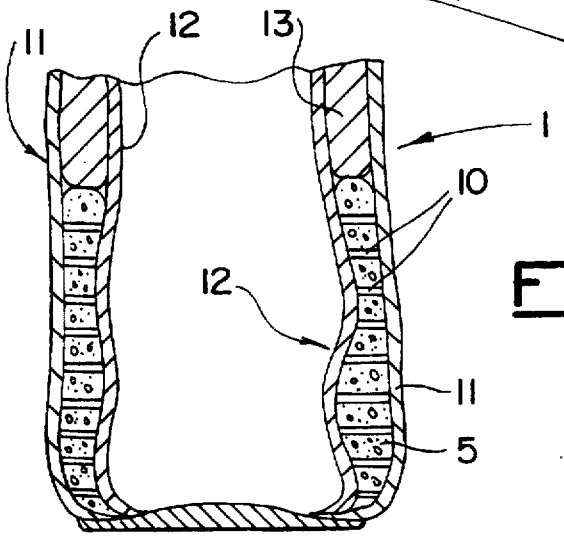
FIG. 2 is a partial cross sectional view along II—II of the liner of FIG. 1.
Figure 3:
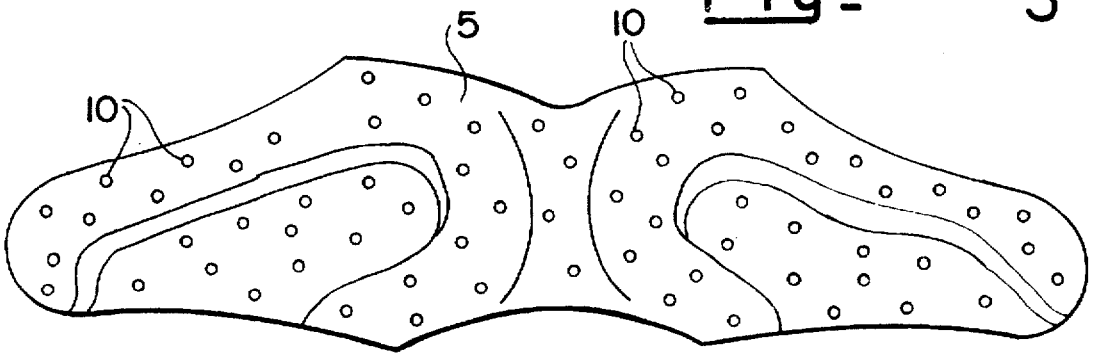
FIG. 3 shows, seen flat, the wedging element which is inserted in the upper of the liner of FIG. 1.

These elements which are preformed by thermocompression are adaptable and adjustable specifically to the shape of a "non-standard" foot simply by reheating up to the temperature which renders them plastic, which allows for their relaxation to a volume close to that which they have before thermocompression. The foot of the skier is thus introduced by force in the liner, i.e., it recompresses at least partially the wedging elements, which thus assume exactly the form of its imprint. The liner being maintained on the foot in the tightening position until cooling of the wedging elements, the latter are stabilized by maintaining the imprint imposed by the foot. According to the invention, these elements which are most often made out of polyethylene, ethylene vinyl acetate co-polymer or of polypropylene, and thus sealed, are micro-perforated in their thickness. These micro-perforations 10, FIGS. 2 and 3, render them more flexible and improve their compressibility even in the thermocompressed state. Likewise, they acquire a certain permeability improving substantially the comfort and hygiene of the foot by virtue of the possible evacuation of sweat. Furthermore, these micro-perforations allow for an in-depth and more rapid diffusion of the heat when one proceeds to reheat the elements for assuming an imprint. This advantage is not negligible because it is thus possible to operate with heat sources which are weaker and thus less destructive to the "skin" of the surface of the elements 5 and 6 which is exposed to the heat sources.

In this embodiment of liner 1, the elements 5 and 6 are interposed between its exterior wall 11 and interior wall 12, and cooperate with the other padding and comfort elements of the liner which are placed at their periphery such as that of 13, which can be made out of foam which is simply compressible. It is self-evident that the ordinary padding elements can likewise be positioned on one and/or the other lateral surfaces of the wedging elements 5 and 6 made of micro-perforated thermoplastic foam.

Figure 4:
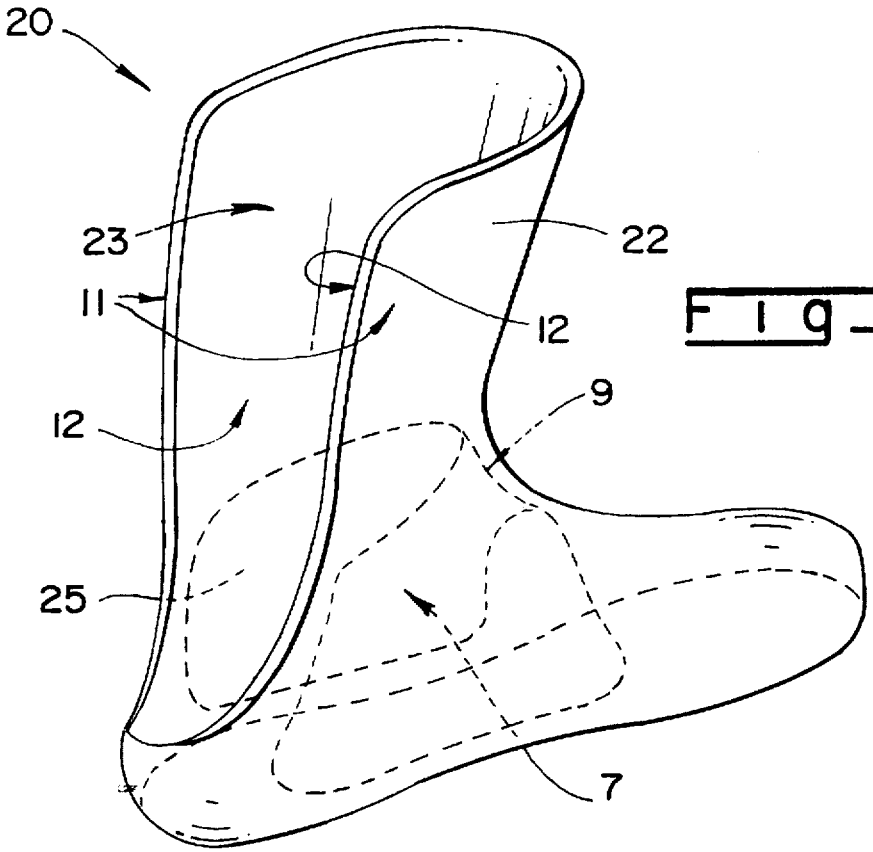
FIG. 4 shows an upper of a rear opening liner provided with a wedging element in the zone extending from the instep/flexion fold to the malleoli.

In the example of FIG. 4, the liner 20 has an upper 22 formed with a rear opening 23 and a wedging element 25 which substantially covers the zones corresponding to the malleoli 7 and to the instep/flexion fold 9. As previously, the wedging element 25 is wedged between the exterior wall 11 and interior wall 12 of the liner.

Figure 5:
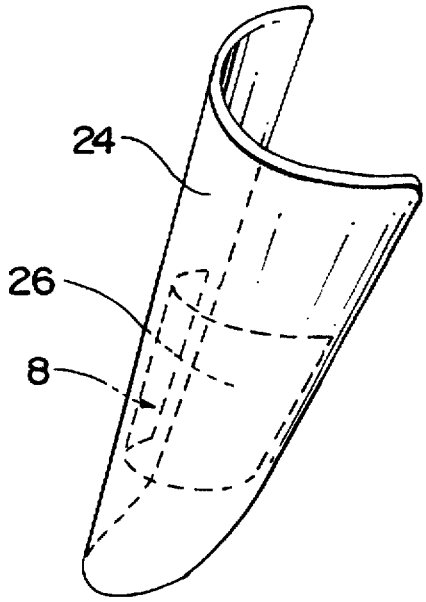
FIG. 5 schematically illustrates the rear comfort wedge of the rear opening liner of FIG. 4, which wedge is provided with a wedging element in the zone corresponding substantially to that of the heel.

This type of liner 20, having a rear opening 23, normally equips the shells of ski boots known as "rear entry" boots; a rear wedge 24; such as illustrated in FIG. 5, is then affixed on the rear portion of the upper of the shell of these boots (not shown) and is adapted to close the said liner 20 on the foot of the skier. Such a wedge 24 can obviously be equipped, for example in the zone of the heel 8, with a wedging element 26 made out of preformed and micro-perforated thermoplastic foam according to the invention.

Figure 6:
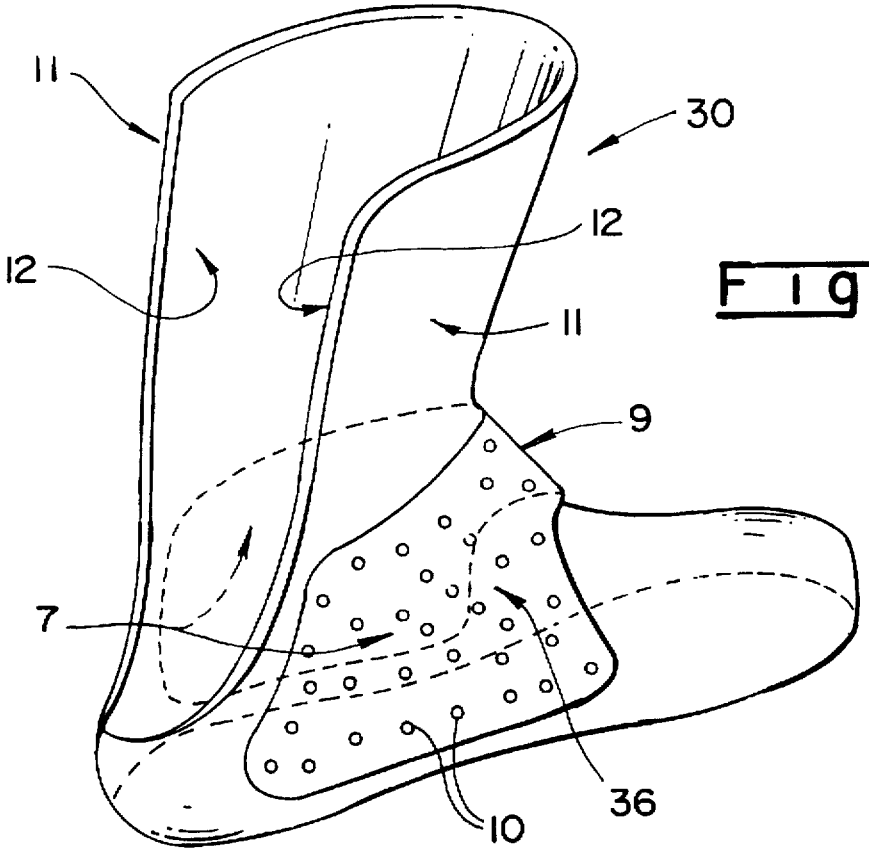
FIGS. 6 and 7 illustrate liners provided with a wedging element according to the invention which is positioned, FIG. 6, on the exterior of the liner, and FIG. 7, on the interior of the liner.
Figure 7:
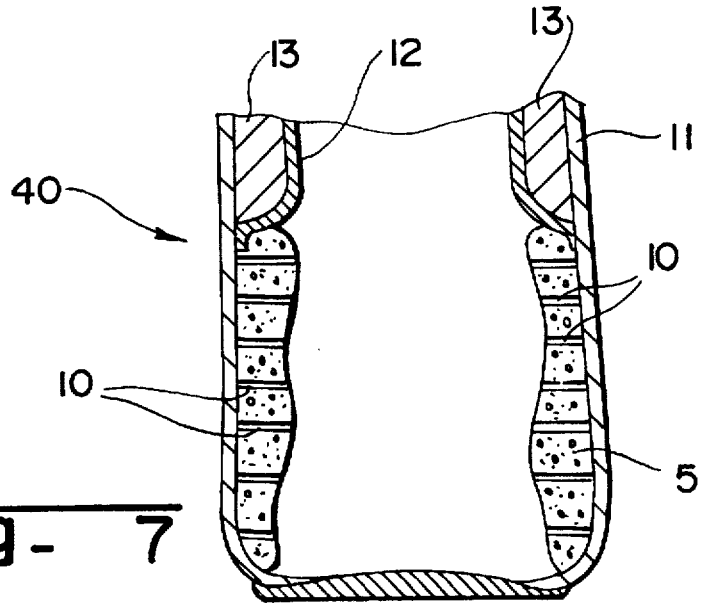

Likewise, such as shown in FIG. 6 and 7, the wedging elements made of preformed and micro-perforated thermoplastic foam can be designed as independent elements and/or additional elements to a comfort liner. Thus, in the example of FIG. 6, the wedging element 36 made out of preformed and micro-perforated thermoplastic foam 10 is adapted on the external wall 11 of the liner 30, and extends substantially on the zone corresponding to the malleoli 7 and to the instep/flexion fold 9.

Furthermore, as shown in FIG. 7, a liner 40 can have one or more ordinary padding elements 13 in the less sensitive zones of the foot, and a reserved location adapted to receive a preformed and micro-perforated thermoplastic wedging element 5 designed independently. By means of this construction, the wedging element is adapted to be positioned immediately adjacent to the foot inserted into the liner.

Thus, this wedging element can be positioned at the last moment in the liner, for example during taking of the imprint of the foot, after reheating outside of the liner.

It is evident that the invention is not limited to a partial wedging element of the liner. Thus, for example, the preformed and micro-perforated thermoplastic wedging element can constitute the liner itself or extend over its entire surface.

Although the invention has been described with reference to particular means, material and embodiments, it is to be understood that the invention is not limited to the particulars disclosed and extends to all equivalents within the scope of the claims.

The instant application is based upon French patent application 94 13735, filed on Nov. 10, 1994, the disclosure of which is hereby expressly incorporated by reference thereto, and the priority of which is hereby claimed under 35 U.S.C. §119.

Finally, although the invention has been described with reference of particular means, materials and embodiments, it is to be understood that the invention is not limited to the particulars disclosed and extends to all equivalents within the scope of the claims.

What is claimed is:

1. A comfort liner for a ski boot, said comfort liner comprising:

at least one wedging element;

said wedging element consisting of a thermoplastic foam material;

said wedging element having micro-perforations for increasing flexibility and elasticity of said wedging element and for rendering said wedging element permeable; and said liner having a shape preformed by thermocompression of said wedging element to have an initial standard fitting volume corresponding to a respective boot size.

2. A comfort liner according to claim 1, further comprising:

an interior wall and an exterior wall; and said wedging element is interposed between said interior wall and said exterior wall of said liner.

3. A comfort liner according to claim 1, further comprising:

an exterior wall having an outer surface; and said wedging element is an independent element attached to said outer surface of said exterior wall.

4. A comfort liner according to claim 1, further comprising:

an inner surface; and said wedging element is an independent element attached to said inner surface of said liner adapted to be exposed to a foot inserted into said liner.

5. A comfort liner according to claim 1, further comprising:

an interior wall and an exterior wall; and said wedging element is affixed to one of said interior and exterior walls and extends over only a portion of said one of said interior and exterior walls.

6. A comfort liner according to claim 1, further comprising:

an interior wall and an exterior wall;

said wedging element is affixed to predetermined portions of one of said interior and exterior walls, said predetermined portions constituting less than an entirety of said interior and exterior walls; and said predetermined portions of one of said interior and exterior walls comprises a malleoli portion and a heel portion.

7. A comfort liner according to claim 1, further comprising:

an interior wall and an exterior wall;

said wedging element is affixed to predetermined portions of one of said interior and exterior walls, said predetermined portions constituting less than an entirety of said interior and exterior walls; and said predetermined portions of one of said interior and exterior walls comprises a malleoli portion and a flexion fold portion.

8. A comfort liner according to claim 1, further comprising:

an interior wall and an exterior wall;

said wedging element is affixed to a predetermined portion of one of said interior and exterior walls, said predetermined portion constituting less than an entirety of said interior and exterior walls;

said predetermined portion of one of said interior and exterior walls comprises a flexion fold portion.

9. A comfort liner according to claim 1, further comprising:

an interior wall and an exterior wall;

said wedging element is affixed to a predetermined portion of one of said interior and exterior walls, said predetermined portion constituting less than an entirety of said interior and exterior walls;

said predetermined portion of one of said interior and exterior walls comprises a heel portion.

10. A comfort liner according to claim 1, wherein:

said micro-perforations are through-holes, extending from a first to a second surface of said liner.

11. A comfort liner according to claim 1, wherein:

said thermoplastic foam material comprises a homogeneous material.

12. A ski boot according to claim 1, wherein:

said thermoplastic foam material of said wedging element has a density greater than 50 $Kg/m^3$.

13. A ski boot comprising:

a comfort liner adapted to be received within a ski boot, said comfort liner comprising:

at least one wedging element;

said wedging element consisting of a thermoplastic foam material;

said wedging element having micro-perforations for increasing flexibility and elasticity of said wedging element and for rendering said wedging element permeable; and said liner having a shape preformed by thermocompression of said wedging element to have an initial standard internal fitting volume corresponding to a respective boot size.

14. A ski boot according to claim 13, wherein:

said micro-perforations are through-holes, extending from a first to a second surface of said liner.

15. A ski boot according to claim 13, wherein:

said thermoplastic foam material comprises a homogeneous material.

16. A ski boot according to claim 13, wherein:

said thermoplastic foam material of said wedging element has a density greater than 50 $Kg/m^3$.

* * * * *